United States Patent [19]

Dillner et al.

[11] 4,175,667

[45] Nov. 27, 1979

[54] METHOD OF PRESHORTENING DRAFT GEAR

[75] Inventors: Arthur M. Dillner, Riverdale; Walter H. Merker, Jr., Downers Grove, both of Ill.

[73] Assignee: Miner Enterprises, Inc., Geneva, Ill.

[21] Appl. No.: 819,258

[22] Filed: Jul. 27, 1977

Related U.S. Application Data

[63] Continuation-in-part of Ser. No. 732,902, Oct. 15, 1976, abandoned.

[51] Int. Cl.[2] ..... B61G 9/02; B61G 9/04; B61G 9/06; B61G 11/00

[52] U.S. Cl. ..... 213/40 R; 188/268

[58] Field of Search ..... 213/43, 40 R, 264; 188/322, 1 C; 264/262

[56] References Cited

U.S. PATENT DOCUMENTS

| | | | |
|---|---|---|---|
| 1,952,446 | 3/1934 | Maas | 264/262 |
| 3,053,526 | 9/1962 | Kendall | 188/268 |
| 3,178,037 | 4/1965 | Kendall | 213/40 R |
| 3,379,318 | 4/1968 | Trongeau | 213/40 R |
| 3,407,752 | 10/1968 | Wallace | 213/40 R |
| 3,608,049 | 9/1971 | Tavella | 264/262 |
| 3,971,551 | 7/1976 | Kendall | 188/322 |

*Primary Examiner*—Trygve M. Blix
*Assistant Examiner*—D. W. Keen
*Attorney, Agent, or Firm*—Darbo & Vandenburgh

[57] ABSTRACT

During manufacture of the draft gear and before it is inserted into the railway car, the piston is positioned in the cylinder in a preshortened position. Part of the fill of flowable, normally solid material is inserted into the cylinder about the piston rod to hold the piston in the preshortened position and the remainder of the fill is inserted between the piston and the closed end of the cylinder. The part of the fill inserted about the piston rod may be in the form of a collar or in the form of particulate material introduced through a port radially opposite the piston rod. This holds the piston in the preshortened position so that the draft gear can easily be inserted into the railway car. After the railway car is put into service the part of the fill about the piston rod breaks down and the piston returns to its normal operating position.

15 Claims, 2 Drawing Figures

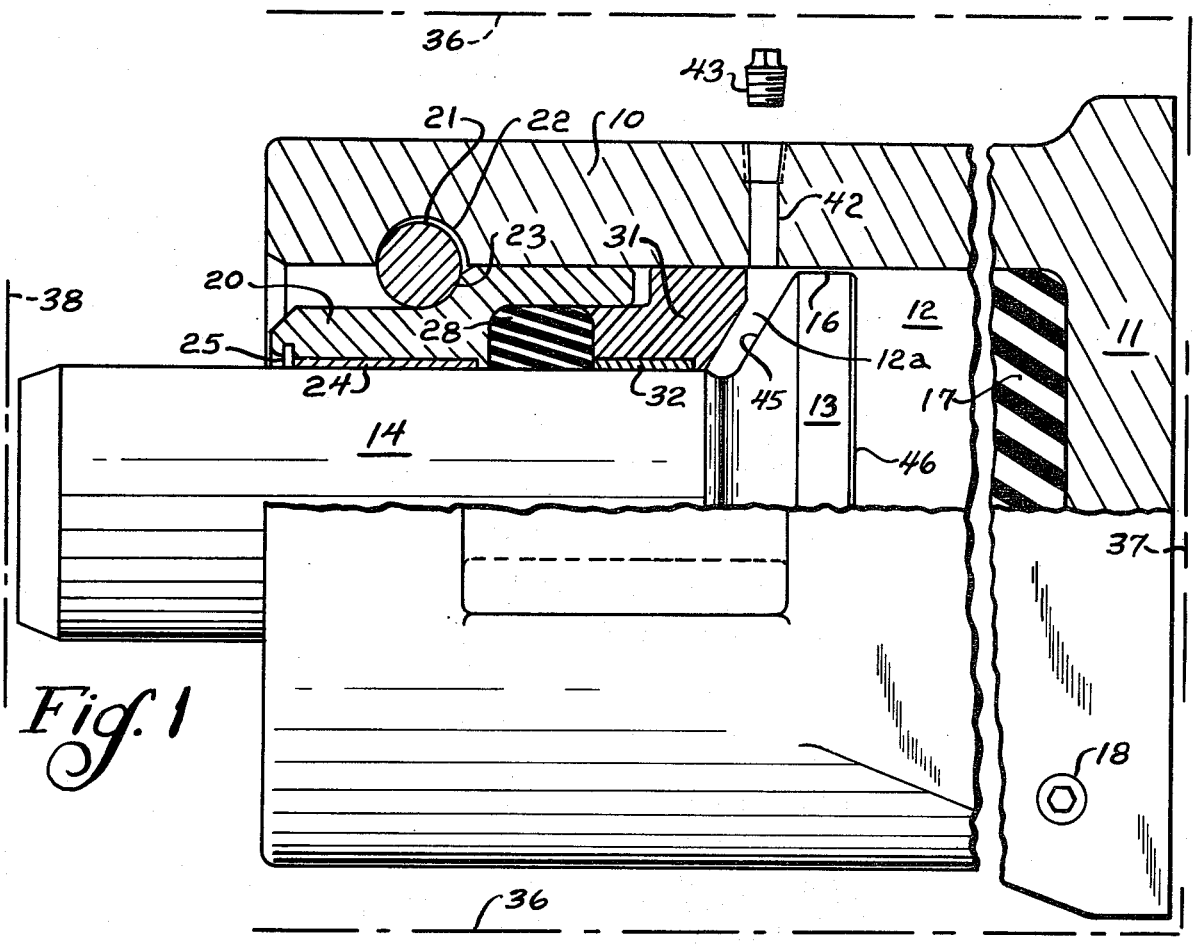
Fig. 1
Fig. 2
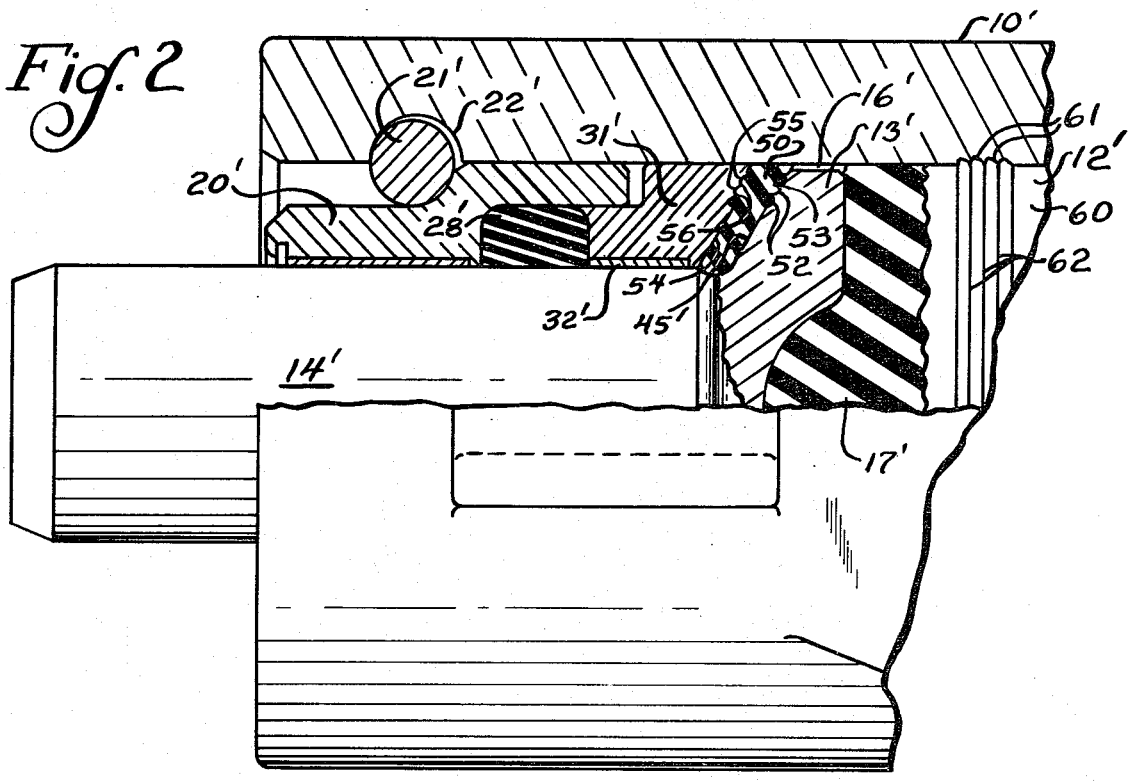

METHOD OF PRESHORTENING DRAFT GEAR

RELATED APPLICATION

This application is a continuation-in-part of our pending application Ser. No. 732,902, filed Oct. 15, 1976, now abandoned.

BACKGROUND AND SUMMARY OF THE INVENTION

The present invention relates to a draft gear of the type of U.S. Pat. No. 3,178,037 wherein the draft gear comprises a piston in a cylinder with the cylinder having a fill of a flowable, normally solid material which material can pass from one side of the piston to the other through an orifice as draft and buff forces are applied to the draft gear. After the draft gear is completely manufactured, it is inserted into a pocket in the railway car. The draft gear and pocket are appropriately sized so that the draft gear is snug in the pocket under normal operating conditions of the railway car. To facilitate inserting the manufactured draft gear into the pocket, it is conventional to preshorten the draft gear, that is to retract the piston and piston rod, thus reducing the overall length of the draft gear and providing adequate clearance to permit the draft gear to be easily inserted into the pocket. A conventional practice for preshortening a draft gear of this kind is to provide a pair of diametrically opposed ears at the closed end of the draft gear housing. Each ear has an opening for accommodating a bolt parallel to the piston rod axis. The other end of each bolt passes through an opening in a heavy steel plate overlying the distal end of the piston rod. By tightening the nuts on the bolt the plate is drawn towards the closed end of the cylinder forcing the piston rod to a retracted position.

The present invention provides an easier and less expensive method and apparatus for preshortening the draft gear prior to its insertion into the railway car. In accordance with the present invention, during the manufacturing operation the piston is located in the preshortened position, part of the fill is inserted into the cylinder about the piston rod and the remainder of the fill is inserted into the cylinder between the piston and the closed end of the cylinder. The part of the fill about the piston rod holds the piston in the preshortened position. After the draft gear has been put into the railway car and the railway car is put in use, that part of the fill about the piston rod breaks down and allows the piston to move to the datum, or normal operating position.

DESCRIPTION OF THE DRAWING

FIG. 1 illustrates a draft gear, partially in section, utilizing a first embodiment of the invention; and FIG. 2 is a view generally corresponding to FIG. 1 of a second embodiment of the invention.

DESCRIPTION OF SPECIFIC EMBODIMENTS

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

A conventional draft gear of the type with which the present invention is concerned comprises a body 10 having a base 11. The body defines a cavity or cylinder

12 in which is positioned a piston 13 having a piston rod 14. There is a clearance or gap 16 between the periphery of the piston and the inner face of the body wall which defines the cavity. This clearance serves as an orifice through which the fill 17 of flowable, normally solid material can move past the piston. The body has an opening extending through the wall and communicating with cavity 12 through which the fill 17 can be introduced into the cavity. In FIG. 1 this opening is closed by a pipe plug 18.

About the piston rod is a retainer sleeve 20. It is held in place by a locking ring 21 seated in a groove 22. The retainer sleeve 20 has an annular abutment 23 which bears against the locking ring 21 and prevents an outward movement of the sleeve 20. This sleeve includes a bearing 24 held in place by a retaining ring 25.

Inwardly of the sleeve is an elastomeric seal 28 of annular configuration. Seal 28 is compressed by an adapter ring 31 movable both with respect to the piston rod and the body.

As thus far described, the draft gear represents a conventional construction. It is inserted into a pocket in the frame of a railway car, which frame pocket is represented by dot-dash lines 36. The car also has a yoke, represented by dot-dash line 37, which pulls against the base 11 when the railway car is in draft. The railway car pocket also includes a movable follower, represented by dot-dash line 38 which bears against the distal end of the piston rod 14 and pushes against it in buff. For further illustration of these railway car features, see for example the aforementioned U.S. Pat. No. 3,178,037. The size of the pocket or opening in the railway car which receives the draft gear has, of course, definite dimensional limitations proportioned to the size of the draft gear. When the draft gear is in a car opening or pocket it is snug therein to prevent any impact or battering between the draft gear and the car structures mentioned. Thus to insert the draft gear therein it is necessary that the piston rod be retracted, i.e., moved to the right in FIG. 1, to provide clearance.

In the embodiment of FIG. 1 a port 42 is provided in the wall of the body 10. This port extends in a radial direction and communicates with that part **12*a* of the cavity 12 which comprises the space about the piston rod when the piston is in the retracted or preshortened position. The port is threaded at its outer end to receive a fill pipe, not shown, and a plug 43. With the piston in the desired preshortened position, the part of the fill 17 representing the main charge is inserted through the opening (defined by pipe plug 18) adjacent the closed end of the cylinder in the usual manner. The remaining part of the fill for the cavity 12 is injected through port 42 into that part of the cavity surrounding the piston rod, i.e., the part of the cavity between the piston and those members closing the open end of the cylinder. This latter part of the fill is in particulate form so that under the static conditions prior to use, it remains in the rearward part 12*a* of the cavity. Preferably the fill inserted into rearward cavity portion 12*a* is injected under greater pressure than the fill 17 put into the main part of the cavity. This does not result in movement of the piston rod since the face 45 is smaller in area (i.e., smaller by the amount of cross-sectional area of the piston rod) than is the area of the face 46 of the piston exposed in the main cavity 12. A check valve, not shown, may be used in port 42 to permit plug 43** to be inserted after the cavity is filled under pressure.

The fill inserted through opening 42 should be compatible with the material of the main charge 17. It would be an elastomer such as, for example, an RTV silicone rubber, an oven cured silicone rubber, a polyester, a fluorelastomer, etc. It should have sufficient strength and resistance to cold-flow so that it will stay in place under static conditions. Frangibility and/or extrudibility should be such that the piston rod will extend to make the gear tight in the pocket after a reasonable number of impacts in classification yards and/or in train operation.

The density of the fill 28 is the primary characteristic of its suitability to stay in place under static conditions, i.e., before the draft gear is put into service in an operating train where it is subjected to draft and buff forces. The suitable density is best expressed in terms of a hardness in the range of 45 to 75 Shore Durometer, Type A-2. A measurement of 60 is eminently suitable. If it is significantly less than 45 it will not stay in place and if over 75 it is too hard for the draft gear to become operable when introduced into service. Other characteristics which can be significant in determining the suitability of a fill include:

A compression set of no more than 25% as measured according to Test D-395 of the American Society For Testing Material for a period of 70 hours at 150° C. A set of 15% is quite suitable.

The cold flow (or creep) should be negligible for a period of 10,000 hours at 15,000 psi.

The tensile strength in pounds psi should be between 600 and 1,200. A figure of 900 is desired.

After the draft gear has been inserted into the car and the car has been put into use, the impacts on the draft gear cause forces to be applied to the distal end of the piston rod and to the body 10 in the sense of forcing the piston towards the closed end of the cavity and of compressing the fill 17 therebetween. As these impact forces are relieved the piston will rebound. This action, plus the fact that the fill in cavity portion 12*a* is under greater pressure than the fill at the other side of the piston, results in a breaking down of the fill in cavity portion 12*a* and a flow thereof through orifice 16. This allows the piston 13 to move to its datum or normal operating position.

FIG. 2 illustrates a second embodiment. In this Figure the functionally corresponding parts have been given the same number as in FIG. 1, but with a prime after the number.

In this embodiment a premolded collar 50 formed of a part of the fill or an elastomeric material compatible with the fill is employed. This collar is slipped onto the piston rod 14' before the piston is inserted into the cylinder, or at least before the seal, etc., are put in place. Thereafter, the adapter ring 31', the seal 28 and the retainer sleeve 20' are put onto the piston rod. With the retainer sleeve 20' inside the cylinder sufficiently to clear groove 22', the locking ring 21' is put in place in the groove. The piston 13' then can be returned to the position illustrated in FIG. 2, which is the preshortened position, and the remainder of the fill put in the cylinder 12' under pressure through the rear fill opening.

In the FIG. 2 embodiment the face 45' of the piston adjacent the piston rod may be formed, as illustrated, with a plurality of annular grooves or depressions 52 defining annular ridges 53. Similarly the adjacent face 54 of the adapter ring may have annular grooves and ridges 55 and 56 respectively, as shown. These serve both to statically retain the collar 50 and to dynamically speed the breakdown of the material of the collar 50.

In this embodiment, as in the embodiment of FIG. 1, the faces 45' and 54 have the configuration of the frustum of a cone whose base is most closely adjacent to the closed end of the cavity, as represented by wall 11. This configuration facilitates the movement of the material from that part of the cavity used for the preshortening fill through the orifice 16, 16' to the main part of the cavity.

In the embodiment of FIG. 2, a part of the inner face 60 of the wall defining the cavity 12' may have a plurality of annular grooves and ridges 61 and 62 respectively, as shown. Again, these serve the purpose of facilitating the breakdown of the material forming the collar in the event the preshortening material or collar tends to follow the piston head down into the cavity 12. These grooves should be sufficiently small in width, as measured parallel to the axis of the cylinder, so as not to increase the flow through the orifice 16' to any significant extent should the piston be opposite them.

The previously described characteristics for the preshortening fill for the embodiment of FIG. 1 are generally applicable for the material for the collar 50. A specific example of a collar material would be a four parts silicone elastomer, such as for example Dow Corning No. 437, mixed with five parts of a fine quartz filler, such as for example Dow Corning Min-U-Sil. After mixing and shaping into the form of the collar it is heat cured. The resulting collar has a 60 Durometer hardness on the C scale. Without the addition of the filler and the heat curing, the silicone elastomer referred to could be employed as the preshortening fill for the embodiment of FIG. 1.

We claim:

1. A draft gear for insertion into a pocket in a railway car which pocket has space limitations, said draft gear comprising a body having two ends and defining a cylinder cavity, a piston rod extending into said cavity at one of said ends, a piston secured to said piston rod, positioned within said cavity and movable within said cavity between a retracted position and a position at which the piston rod is fully extended, said piston having two faces, one of which faces surrounds said piston rod, the area of said one face being significantly smaller than the area of the other of said faces, a pressurized fill of flowable, normally solid means within said cavity for resisting draft and buff forces, and means defining a restricted flow passage from one side of the piston to the other through which said fill can flow as draft and buff forces are applied to the draft gear, said draft gear being of a size such that, prior to the draft gear being inserted into the pocket, the distance between the distal end of the piston rod when fully extended and the other end of the body is greater than said space limitations of said pocket, said draft gear prior to installation being characterized by:

said piston being sufficiently retracted within said cavity so that the distal end of the piston rod projects insufficiently far beyond the body to cause the overall configuration of the draft gear to exceed said space limitations;

a first portion of said fill being in the part of the cavity surrounding said piston rod and being sufficiently solid to prevent movement of the piston toward the position at which the piston rod is fully extended in the absence of said forces being applied to the draft gear, and substantially the remaining portion of the fill being in the part of the cavity at the opposite side of the piston, the remaining portion of said fill being less dense than said first portion;

whereby the draft gear is easily insertable into said pocket.

2. A draft gear as set forth in claim 1, wherein said first portion is in the form of a preformed collar.

3. A draft gear as set forth in claim 1, wherein said first portion comprises particles of said flowable, normally solid means.

4. A draft gear as set forth in claim 3, wherein the body defines a radial port extending through the body at the location occupied by said first portion, through which port said first portion may be inserted.

5. A draft gear as set forth in claim 1, wherein said first portion is compatible with said remaining portion of said fill.

6. A draft gear as set forth in claim 5, wherein said first portion of fill possesses a hardness of 45 to 75 Shore Durometer, Type A-2.

7. A draft gear as set forth in claim 1, wherein the first portion of said fill:

possesses a hardness of 45 to 75 Shore Durometer, Type A-2;

possesses a compression set of not more than 25% upon the employment of Test D-395 of the American Society For Testing Material for a period of 70 hours at 150° centigrade;

possesses negligible cold flow or creep under a maximum of 15,000 pounds of pressure per square inch for a period of 10,000 hours; and possesses tensile strength of between 600 and 1,200 pounds per square inch.

8. A draft gear as set forth in claim 1, wherein the piston has a face extending outwardly from said piston rod, and including means about said piston rod and defining a face in juxtaposition to said piston face, said draft gear being further characterized by:

at least one of said faces including a plurality of depressions and ridges to facilitate breaking down said first portion of said fill.

9. A draft gear as set forth in claim 8, wherein said faces are in the form of a frustum of a cone whose base is most closely adjacent the closed end of the body cavity.

10. A draft gear as set forth in claim 8, wherein the body wall defining said cavity has a plurality of depressions and ridges to facilitate breaking down said first portion of the fill.

11. A draft gear as set forth in claim 1, wherein the piston has a face extending outwardly from said piston rod, and including means about said piston rod and defining a face in juxtaposition to said piston face, said draft gear being further characterized by:

said faces being in the form of a frustum of a cone whose base is most closely adjacent the closed end of the body cavity.

12. A draft gear as set forth in claim 1, wherein the body wall defining said cavity has a plurality of depressions and ridges to facilitate breaking down said first portion of the fill.

13. A method of preshortening a draft gear for insertion into a pocket in a railway car which pocket has space limitations, which draft gear is subjected to externally applied forces resulting from draft and buff of the car when in train operation, said draft gear comprising a body defining a cylinder cavity, a piston rod extending into said cavity, a piston secured to said piston rod, positioned within said cavity and movable within said cavity between a retracted position and a position at which the piston rod is fully extended, a fill of flowable, normally solid means within said cavity for resisting draft and buff forces, and means defining a restricted flow passage from one side of the piston to the other through which said fill can flow as draft and buff forces are applied to the draft gear, said method comprising the steps of:

positioning said piston within said cavity at a location such that the distal end of the piston rod projects insufficiently far beyond the body to cause the overall configuration of the draft gear to exceed said space limitations and introducing a first fill in the part of said cavity about the piston rod which fill is sufficiently dense so as to prevent, in the absence of said externally applied forces, the movement of the piston toward the position at which the piston rod is fully extended, and introducing a second fill into the part of said cavity on the side of the piston opposite to said first mentioned part which is less dense than said first fill to thereby establish said position of said piston prior to the insertion of said draft gear into said pocket.

14. A method as set forth in claim 13, wherein after said piston is so positioned the fill is introduced into the cavity under pressure from opposite sides of said piston.

15. A method as set forth in claim 14, including the steps of preforming the first part of said fill into the form of a collar, positioning said collar about said piston rod in juxtaposition to said piston before said draft gear is assembled, thereafter assembling said draft gear, and thereafter introducing said second part of said fill into said cavity.

* * * * *

UNITED STATES PATENT AND TRADEMARK OFFICE

CERTIFICATE OF CORRECTION

PATENT NO. : 4,175,667

DATED : November 27, 1979

INVENTOR(S) : Arthur M. Dillner and Walter H. Merker, Jr.

It is certified that error appears in the above-identified patent and that said Letters Patent are hereby corrected as shown below:

Column 6, line 45, "14" should read --13--.

Signed and Sealed this

*Twenty-fifth* Day of *March 1980*

[SEAL]

*Attest:*

SIDNEY A. DIAMOND

*Attesting Officer*

*Commissioner of Patents and Trademarks*